US009185997B2

(12) United States Patent
Woods et al.

(10) Patent No.: US 9,185,997 B2
(45) Date of Patent: Nov. 17, 2015

(54) CONTAINER DISPENSER

(75) Inventors: Rick Woods, Rockton, IL (US); Bernie Ziebart, Pewaukee, WI (US); Erik Feuerstein, Milwaukee, WI (US)

(73) Assignee: San Jamar, Inc., Elkhorn, WI (US)

( * ) Notice: Subject to any disclaimer, the term of this patent is extended or adjusted under 35 U.S.C. 154(b) by 175 days.

(21) Appl. No.: 14/111,710

(22) PCT Filed: Apr. 14, 2011

(86) PCT No.: PCT/US2011/032403

§ 371 (c)(1),
(2), (4) Date: Oct. 14, 2013

(87) PCT Pub. No.: WO2012/141705

PCT Pub. Date: Oct. 18, 2012

(65) Prior Publication Data

US 2014/0034666 A1 Feb. 6, 2014

(51) Int. Cl.
*A47F 1/12* (2006.01)

(52) U.S. Cl.
CPC ..... *A47F 1/123* (2013.01); *A47F 1/121* (2013.01)

(58) Field of Classification Search
None
See application file for complete search history.

(56) References Cited

U.S. PATENT DOCUMENTS

| | | | | | |
|---|---|---|---|---|---|
| 2,742,200 | A * | 4/1956 | Marx | 222/370 |
| 3,627,317 | A * | 12/1971 | Whitsitt | 273/447 |
| 3,756,471 | A * | 9/1973 | Wissman | 222/156 |
| 3,900,133 | A * | 8/1975 | Lisbin et al. | 221/280 |
| 4,151,946 | A * | 5/1979 | Schmidt et al. | 229/221 |
| 4,476,996 | A * | 10/1984 | Moore et al. | 221/61 |
| 4,651,874 | A * | 3/1987 | Nakamura | 206/205 |
| 4,823,984 | A * | 4/1989 | Ficken | 221/96 |
| 4,907,825 | A * | 3/1990 | Miles et al. | 281/51 |
| 4,955,486 | A * | 9/1990 | Trulaske, Sr. | 211/59.2 |
| 4,998,628 | A * | 3/1991 | Ross | 211/59.2 |
| 5,076,443 | A * | 12/1991 | Trulaske, Sr. | 211/59.2 |
| 5,390,802 | A | 2/1995 | Pappagallo et al. | |
| 5,700,075 | A * | 12/1997 | Perone | 312/45 |
| 6,234,330 | B1 * | 5/2001 | Gray | 211/106 |
| 6,340,091 | B1 * | 1/2002 | Romeo et al. | 211/59.2 |
| 6,460,701 | B1 * | 10/2002 | Nytko | 206/349 |
| 6,581,789 | B1 * | 6/2003 | Spanski et al. | 211/106 |
| 7,303,095 | B2 * | 12/2007 | Nagelski et al. | 221/256 |
| 7,398,888 | B1 * | 7/2008 | Nowak | 211/59.2 |
| 7,837,044 | B2 * | 11/2010 | Whitty | 211/106 |
| 8,418,859 | B2 * | 4/2013 | Chen | 211/59.2 |
| 2004/0182976 | A1 | 9/2004 | Valiulis et al. | |
| 2005/0072747 | A1 * | 4/2005 | Roslof et al. | 211/59.3 |
| 2005/0082246 | A1 * | 4/2005 | Krummell et al. | 211/151 |
| 2006/0186000 | A1 * | 8/2006 | Gregory et al. | 206/315.9 |
| 2009/0145869 | A1 | 6/2009 | Battaglia | |
| 2012/0325840 | A1 * | 12/2012 | Restaino | 221/279 |
| 2012/0325841 | A1 * | 12/2012 | Restaino | 221/282 |
| 2012/0325842 | A1 * | 12/2012 | Restaino | 221/282 |
| 2013/0277384 | A1 * | 10/2013 | Gelfand | 221/45 |

* cited by examiner

*Primary Examiner* — Gene Crawford
*Assistant Examiner* — Ayodeji Ojofeitimi
(74) *Attorney, Agent, or Firm* — Boyle Fredrickson, S.C.

(57) ABSTRACT

A container dispenser includes structure to support a nested stack of containers. The dispenser includes a crossbar at the lower end of the structure and a pair of spaced apart upright posts to which a retention wire clip may be removably mounted. The wire clip is designed to engage the exterior side wall or lip of the outermost cup of the nested stack, and in effect, hold the outermost container against the cross bar. This not only keeps the outermost container from falling away from the dispenser but also retains the nested stack in the dispenser. The retention wire clip is preferably formed of spring steel.

17 Claims, 11 Drawing Sheets

CONTAINER DISPENSER

BACKGROUND OF THE INVENTION

The present invention is generally directed to cup dispensers and, more particularly, to a countertop supported dispenser for dispensing beverage cups and the like.

Beverage cup dispensers, such as those typically found in fast food restaurants, convenience stores, and similar establishments, are often of a type that include a rack or housing into which one or more nested stacks of paper, plastic or foam beverage cups can be loaded. In one type of dispenser, a spring or similar biasing force (e.g., gravity) is applied at the feed end of a tubular housing to bias a nested stack of beverage cups (or containers) toward a discharge opening formed in the opposite end of the tubular housing. Clips or a flexible gasket (diaphragm) are secured to the discharge end of the tubular housing and engage the outer surface or lip of the outermost cup of the nested stack. The clips or the flexible gasket apply a small resistive force to the spring bias to hold the nested stack of cups in the tubular housing. When the outermost cup is withdrawn from the tubular housing, the resistive force opposing the spring bias is momentarily relieved which allows the spring to force the next cup in the nested stack into the discharge opening. More particularly, as the outermost or lowermost cup is extracted from the nested stack, the clips or flexible gasket are forced outward thus relieving the holding force on the lowermost cup. When the cup has been fully withdrawn from the dispenser, the clips or flexible gasket engage the next cup in the nested stack so as to retain the nested stack in the tubular housing. Some beverage cup dispensers are fitted with one more coils at the discharge end of the tubular housing that are operative to hold the nested stack of beverage cups in the tubular housing and grab the next cup in the nested stack when the outermost or lowermost cup is being withdrawn.

Flexible gaskets are commonly used to engage the outermost cup of the nested stack because they can accommodate cups of different diameters without requiring customer modification. Over time however the gaskets can began to wear and lose their shape memory. Also, the gaskets can begin to tear. Clips have been designed that have a longer usable life than gaskets but clips typically require an end user, i.e., customer, to set the position of the clips to accommodate a given cup diameter. In many instances, three or more radially spaced clips are used and thus requires the customer to set the position of several clips. Additionally, if the clips are not properly positioned, a cup, as it is being withdrawn, may be pulled askew, which can mar or damage the cup rendering it unusable. Coils can be similarly difficult to position and if not properly tensioned can result in double dispensing or damage to the cup as it being withdrawn.

Conventional tubular dispensers are also generally large and relatively costly to manufacture. The tubular dispensers require the tubular housing, one or more end caps at the feed and discharge ends, the aforementioned clips or gasket, and a lengthy metallic spring. When paired or tripled together to accommodate multiple cup sizes, the footprint of the beverage cup station can be quite large and occupy significant countertop space.

To eschew the complexity and costliness of conventional spring-biased beverage cup dispenser such as those described above, low cost pull-type dispensers have been developed that rely solely upon gravity to present a nested stack of beverage cups for one-at-a-time dispensing. In addition to be generally cheaper to manufacture, these pull-type dispensers are typically lighter and smaller than other types of beverage cup dispensers, making their use preferred for convenience stores, cafeterias, fast food restaurants, and the like.

These pull-type beverage cup dispensers typically have a cuboid wire frame designed to hold one or more nested stacks of beverage cups. The frame includes one or more ramps along which the nested stacks of beverage cups sit so that gravity can force the nested stacks toward respective dispensing ends at the front of the cuboid frame. Alternately, the ramps could be planar and a spring could bias the nested stack toward the dispensing end. In one form, rather than clips or gaskets, one or more springs are arranged horizontally across the front of the frame in a cup dispensing lane. The spring is designed to catch the lip of an outermost (lowermost) beverage cup as the previous outermost beverage cup is being extracted. In some instances, a pair of springs arranged side-by-side, front-to-back are used to cooperatively catch the lip of the outermost beverage cup. One of the drawbacks of using the spring to keep the nested stack of cups from falling out of the dispenser is tuning the spring to match the type and size of cups to be dispensed. That is, if the spring applies too great a holding force, the spring may mar the beverage cups as they are being extracted. On the other hand, if the spring applies too loose a holding force, the spring may be unable to effectively "catch" the next beverage cup resulting in multiple cups being extracted at a time. In both instances, an improperly tuned spring can result in unnecessary beverage cup waste.

SUMMARY OF THE INVENTION

The present invention provides a cup dispenser of simple design and low material costs that overcomes the drawbacks of conventional pull-type beverage cup dispensers. The cup dispenser can accommodate one or more nested stacks or magazines of cups or similar nested containers, such as beverage cups, condiment containers, bowls, pill boxes, and the like. The dispenser can be easily modified to handle containers of different diameters. The dispenser can also hold lids and straws to provide a fully integrated countertop container station.

According to one aspect of the invention, a container dispenser includes structure to support a nested stack of containers. This dispenser includes a crossbar at the lower end of the structure and a pair of spaced apart upright posts to which a retention wire clip may be removably mounted. The wire clip is designed to engage the exterior side wall or lip of the outermost cup of the nested stack, and in effect, hold the outermost container against the cross bar. This not only keeps the outermost container from falling away from the dispenser but also retains the nested stack in the dispenser.

The retention wire clip is preferably formed of spring steel.

In one embodiment, coils fit over the upright posts with the turns of the coil spring defining multiple heights along the upright posts to which the ends of the wire clip may be removably mounted. The vertical spacing between the wire clip and the crossbar can thus be adjusted to match the size of the container to be dispensed.

In another embodiment of the invention, the outer faces of the upright posts are notched and define a range of positions at which the wire clip can engage the upright posts.

In another embodiment, the inner sidewalls of the upright posts are machined or otherwise formed to have a set of holes vertically spaced from one another. The holes are designed to receive a butt-end of the wire clip.

The container dispenser may be sized to accommodate an array of different container sizes and is not limited to a particular type of container. For example, the dispenser may be used to dispense plastic, foam, or paper containers. The dispenser can be used to dispense lipped or lipless containers. The dispenser can be used to dispense beverage cups, such as soda or coffee cups as well as bowls, food receptacles, pill containers, condiment containers, and other nested objects. It will thus be appreciated that the invention may be used to provide controlled dispensing of any type of nested receptacle.

Various features and advantages of the present invention will be made apparent from the following detailed description taken together with the drawings.

BRIEF DESCRIPTION OF THE DRAWINGS

The drawings illustrate the best mode presently contemplated of carrying out the invention.

In the drawings.

DETAILED DESCRIPTION

The present invention will be described with respect to a beverage cup dispenser but it is understood that the invention is not so limited and thus could used with dispensers that dispense other types of nested articles, such as bowls, food containers, dome lids, pill containers, candy or similar particulate containers, such as those used for holding nuts, cashews, and the like. Additionally, while a dispenser adapted for use with beverage cups ranging from 3⅛ inches in diameter to 4½ inches in diameter will be described, it is understood that the invention is usable with containers that fall outside this range. For example, the invention could be used for dispensing large tubs, such as popcorn tubs, that are typically over 5 inches in diameter.

Figure 1:
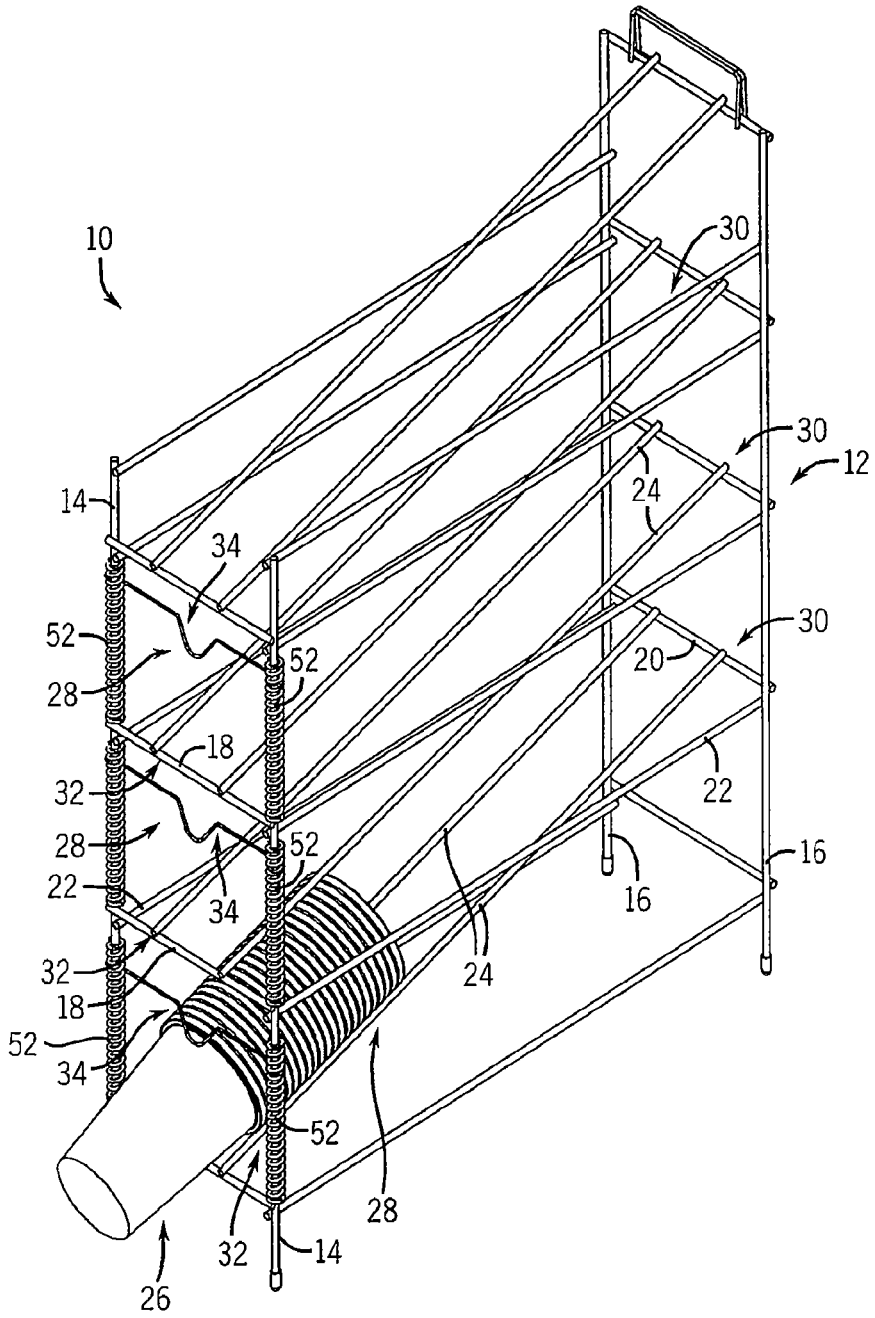
FIG. 1 is an isometric view of a beverage cup dispenser according to one embodiment of the present invention.
Figure 1A:
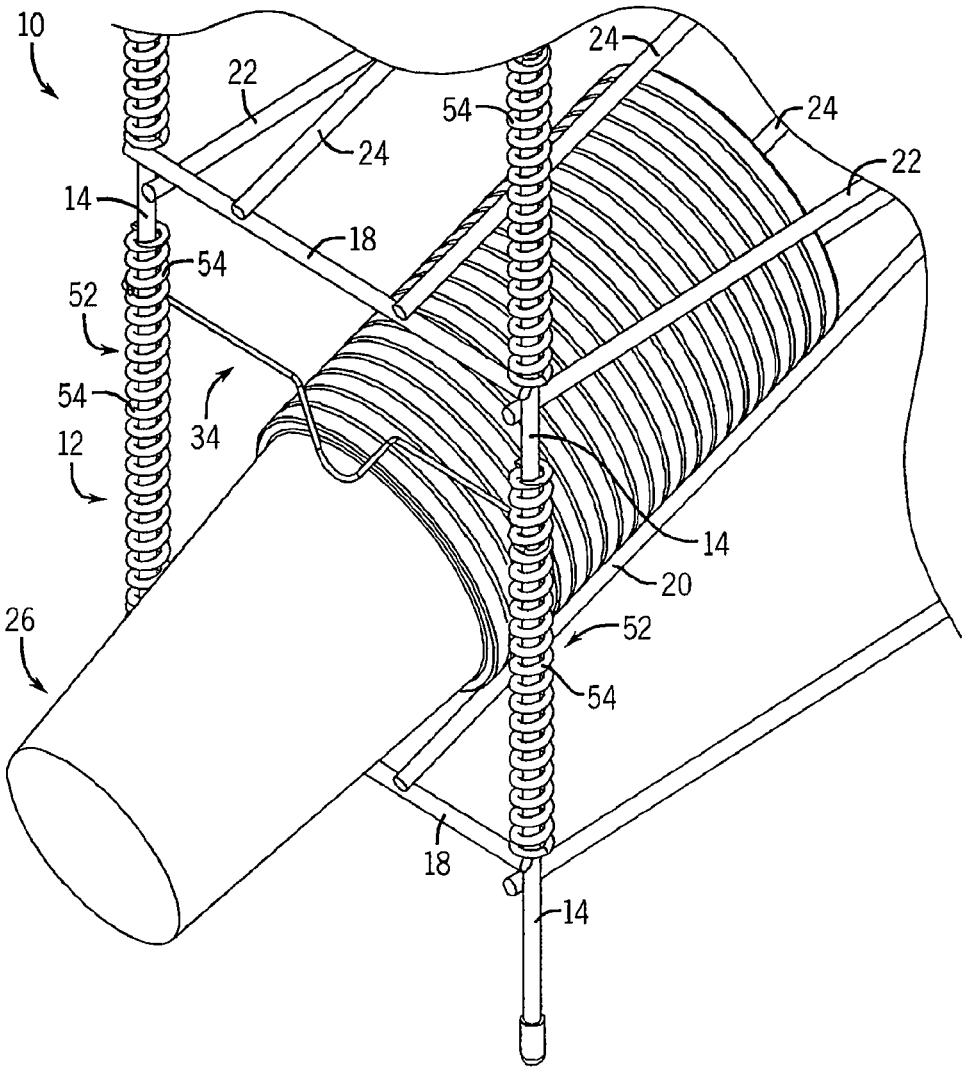
FIG. 1A is an enlarged isometric view of a portion of the beverage cup dispenser of FIG. 1.
Figure 2:
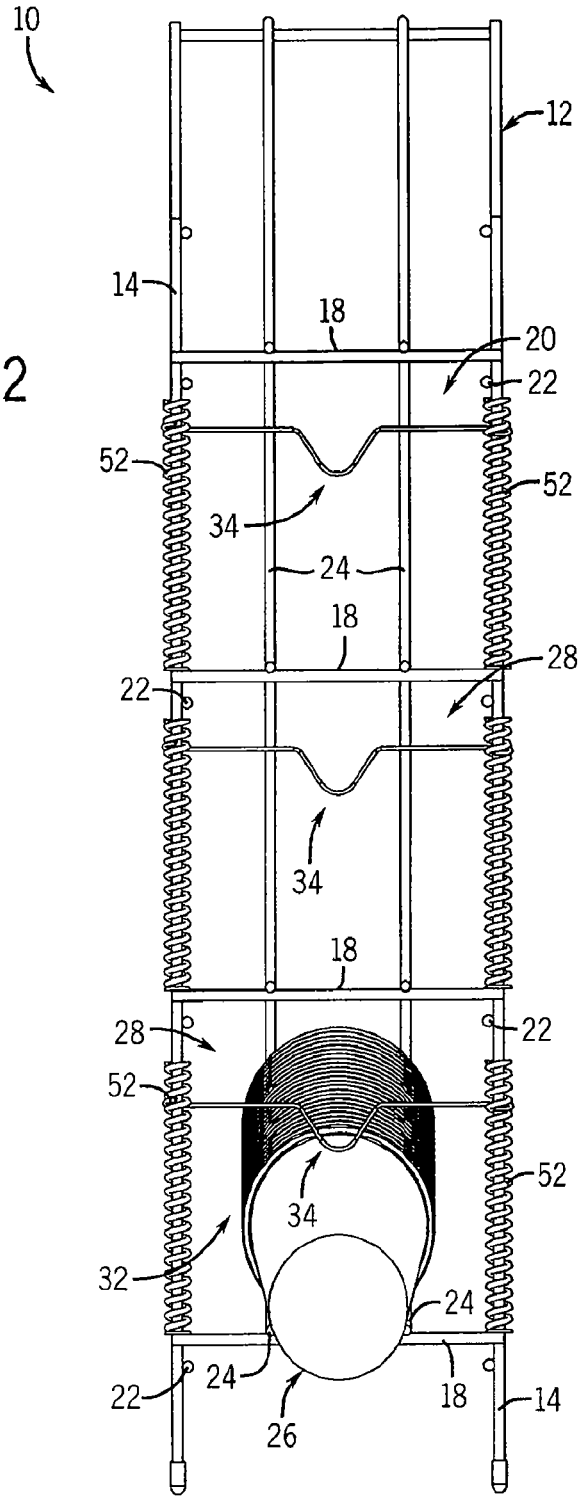
FIG. 2 is a front elevation view of the beverage cup dispenser of FIG. 1.
Figure 3:
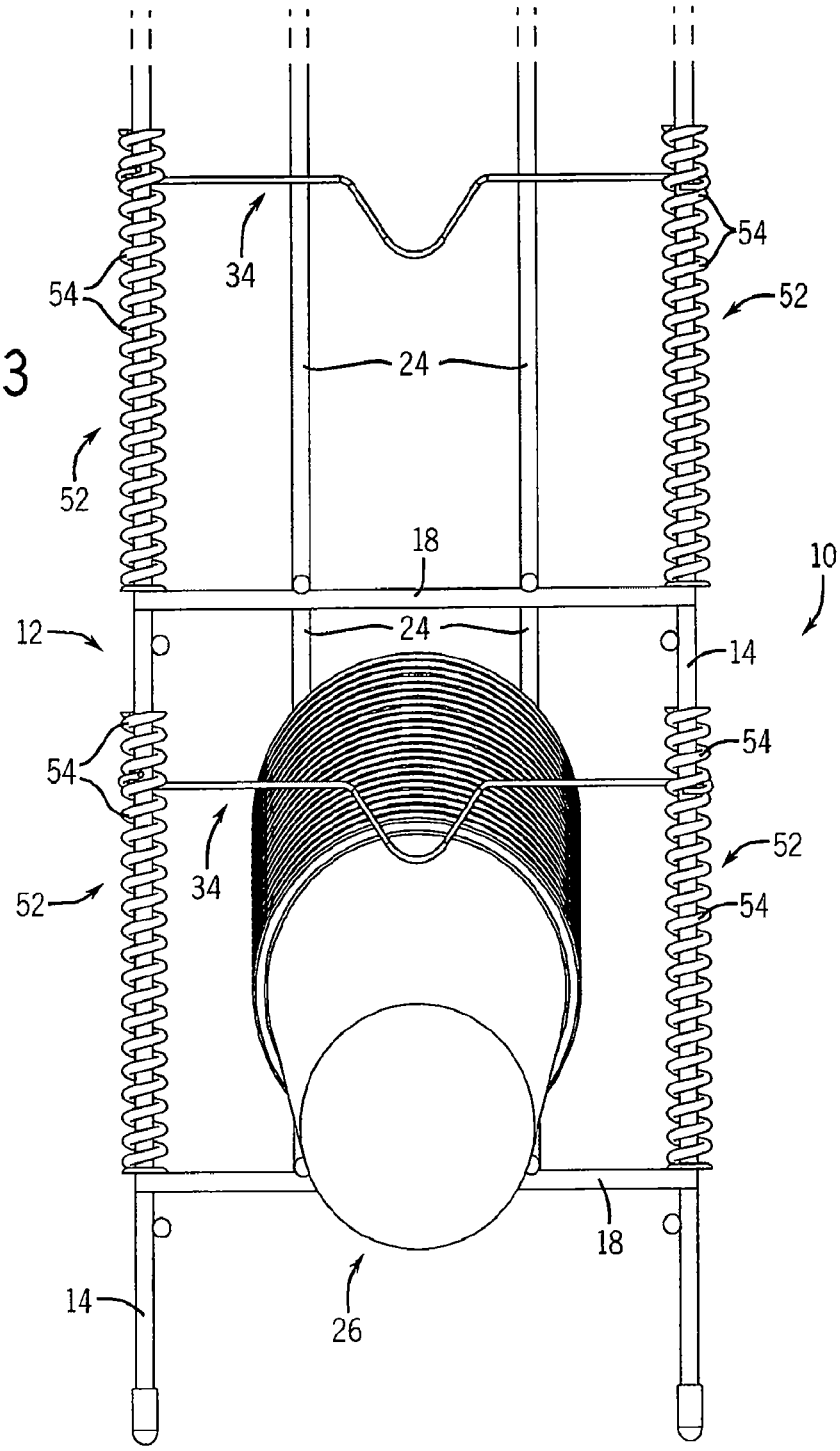
FIG. 3 is an enlarged front elevation view of a portion of the beverage cup dispenser of FIG. 1.
Figure 5:
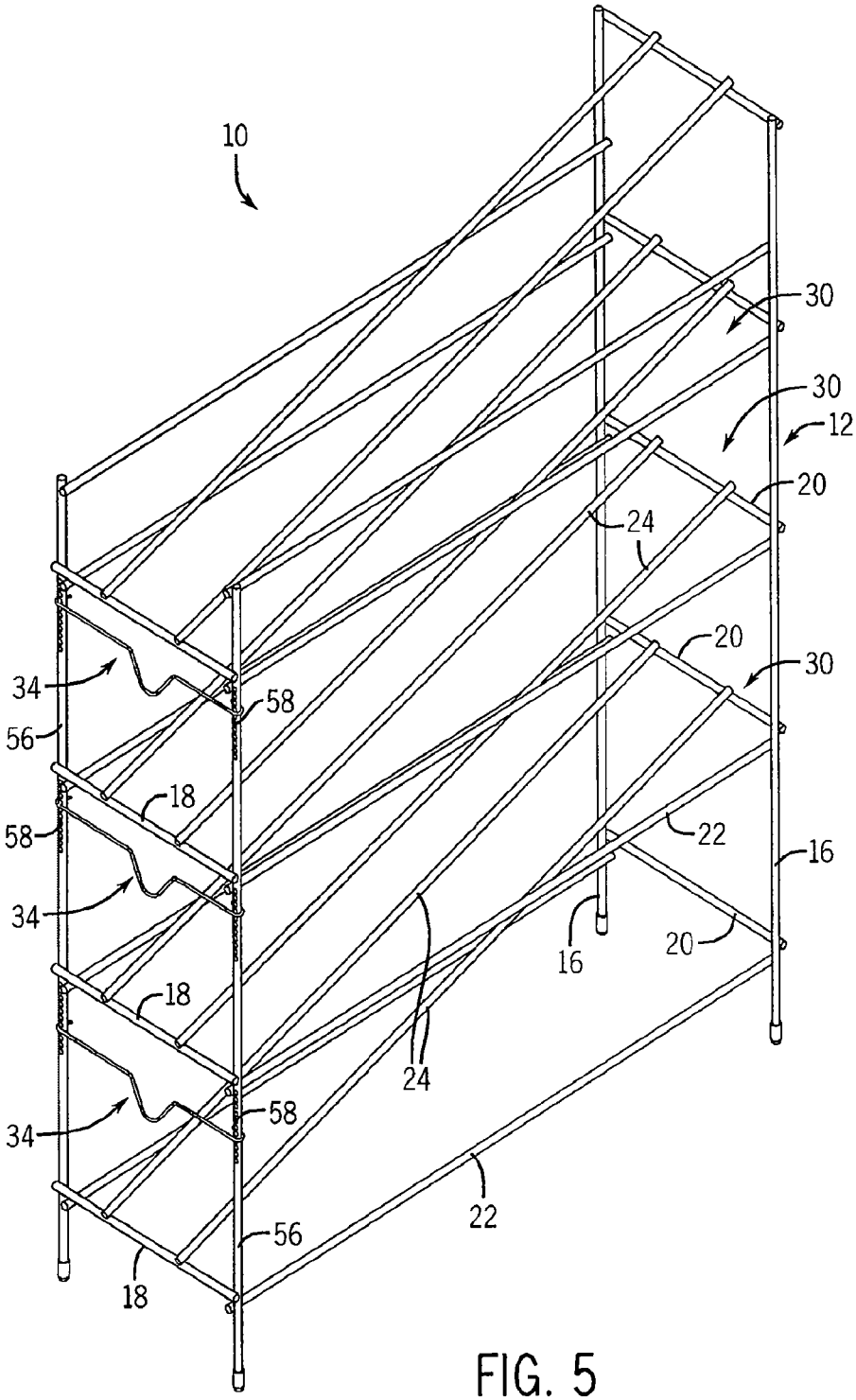
FIG. 5 is an isometric view of a beverage cup dispenser according to another embodiment of the invention.

Turning now to FIGS. 1 and 5, a pull-type cup dispenser 10 has a frame 12 defined by front legs or upright posts 14, rear legs or upright posts 16, front and rear crossbars 18 and 20, respectively, horizontal or stabilizing frame members 22, and inclined rails 24 that are sloped at an angle of approximately 17 degrees toward the front of the frame 12. The rails 24 essentially create a ramp providing an inclined surface against which a nested stack of beverage cups 26 may lay when loaded into the dispenser 10. It will be appreciated that the construction of the frame 12 defines a set of vertically arranged dispensing chambers (shelves) 28, with each having a feed (rear) end 30 at the rear of the frame 12 and a discharge end 32 at the front of the frame 12.

In one construction of the dispenser 10, adjacent front crossbars 18 together with the front upright posts 14 frame a discharge end 32 for a given dispensing chamber 28. The spacing between the front posts 14 and crossbars 18 is sufficient to accommodate cups having a diameter of 4½ inches, which is larger than an industry standard thirty-six ounce beverage cup. Also, in one embodiment, the crossbars 18 have a centrally positioned dip or length of convexity that provides a radius or curvature to accommodate the curved outer surface of the beverage cups.

Figure 4:
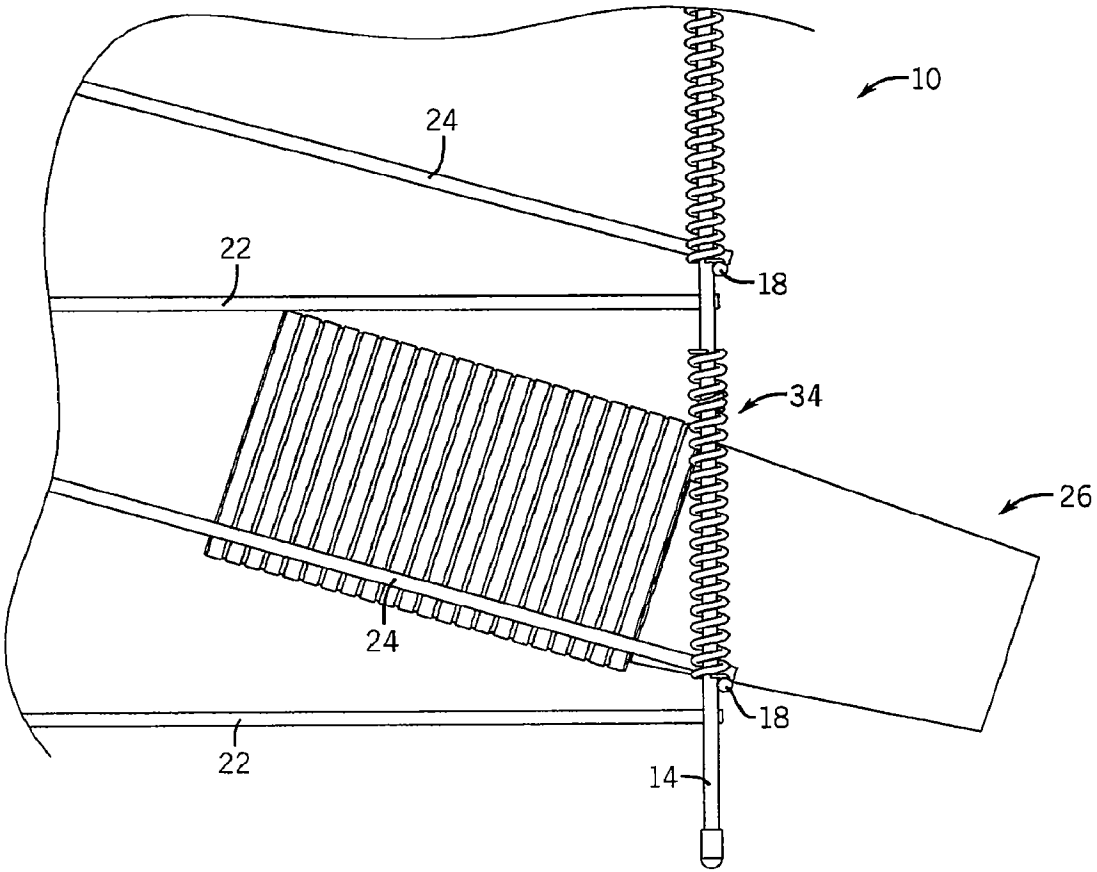
FIG. 4 is a side elevation view of a portion of the beverage cup dispenser of FIG. 1.
Figure 8:
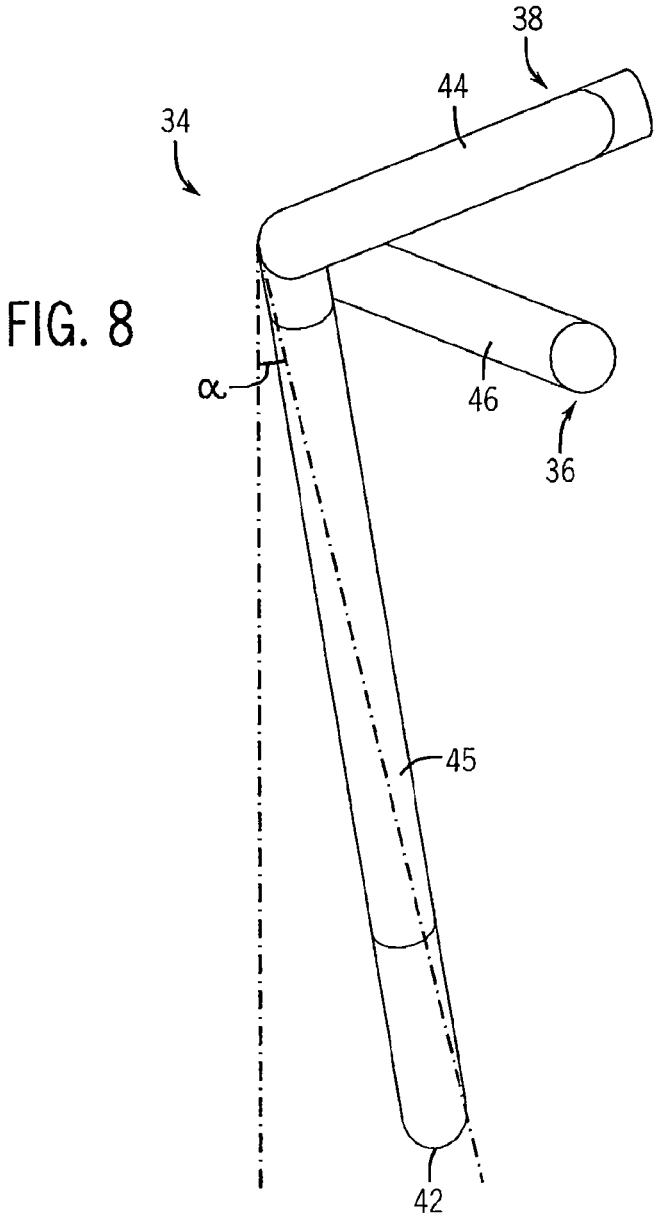
FIG. 8 is a side elevation view of the wire clip of FIG. 7.

With additional reference to FIGS. 4 and 8, each set of inclined rails 24 includes a pair of elongated members connected at one end to a front crossbar 18 and connected at an opposite end to a rear crossbar 20. In the illustrated embodiment, the elongated rods have a curved outer surface and run parallel to one another. Moreover, the elongated rods extend between vertically offset front and rear crossbars 18 and 20. That is, to achieve the desired inclination for the rails 24, the forward ends of the rails 24 are connected, e.g., welded, to a front crossbar 18 that is along a vertical plane that is lower than the rear crossbar 20 to which the opposite ends of the rails 24 are connected. For example, in the illustrated embodiment, the rails 24 extend between the front crossbar 18 that defines the lower end of a discharge end 32 and the rear crossbar 20 that is aligned with the front crossbar 18 defining the lower end of the discharge end 32 for the dispensing chamber 28 immediately thereabove.

Figure 7:
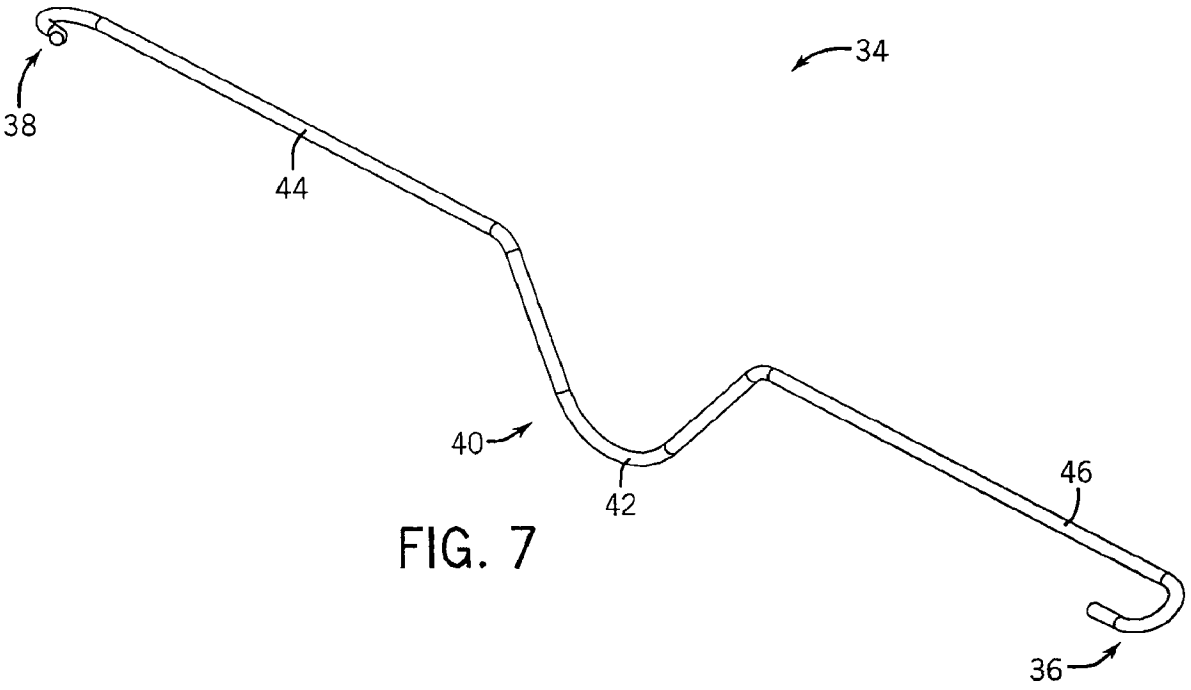
FIG. 7 is an isometric view of a wire clip for use with the beverage cup dispensers of FIGS. 1 and 5 according to another embodiment of the invention.

With additional reference now to FIGS. 7 and 8, the beverage cup dispenser 10 has wire clips 34 for engaging the outer surfaces of the outermost cups 26 of the individual nested stacks. In this regard, there is a wire clip 34 for each dispensing chamber 28. As will be described more fully below, the positioning of the wire clips 34 can be varied to accommodate different sized beverage cups. The wire clips 34 are preferably formed from spring steel and more preferably from 16 (0.060°) gauge spring steel having a spring force of approximately 9.0 in/lbs.

Wire clip 34 is of single piece construction and has a length sufficient to at least span the width of the discharge end 28 of the dispensing chamber 28. In one embodiment, the length of the wire clip prior to shaping is 7⅔ inches and after shaping is 6¼ inches. The wire clip 34 has first and second end portions 36 and 38 defined at opposite ends of a bent portion 40. The end portions 36 and 38 are designed to engage respective front posts 14 of the frame 12. In the illustrated embodiment, each end has a partial helix shape that wraps partially around the upright posts when attached thereto. It is contemplated, however, that the ends could be shaped or formed differently as long as the ends sufficiently engage the front posts 14 so as to substantially fix the ends of the clip vertically relative to the posts and any cups to be dispensed. The bent portion 40 includes a cup engaging portion 42 and extends from the ends by connecting sections or portions 44 and 46.

The wire clip 34, as noted above, is formed from an elongated piece of spring steel. The piece is shaped such that the cup engaging portion 42 is laterally and/or vertically offset from the connecting portions 44 and 46, as shown in FIG. 8. The cup engaging portion 42 is forward and/or below the connecting portions 44 and 46. This offsetting of the cup engaging portion 42 enables the clip to engage the outermost cup 26 of the nested stack and apply a holding force against the cup 26 without damaging or marring the cup 26. In one embodiment, the forward offset of the cup engaging portion 42 (angle $\alpha$ in FIG. 8) is approximately 10 degrees when the wire clip is at rest. The offset also allows the clip 34 to ride up over the rim of a cup without hooking or catching on that rim. It further acts to separate the cups by immediately applying a force to the next cup in the stack after the cup engaging portion of the clip 34 passes over the rim.

Figure 9:
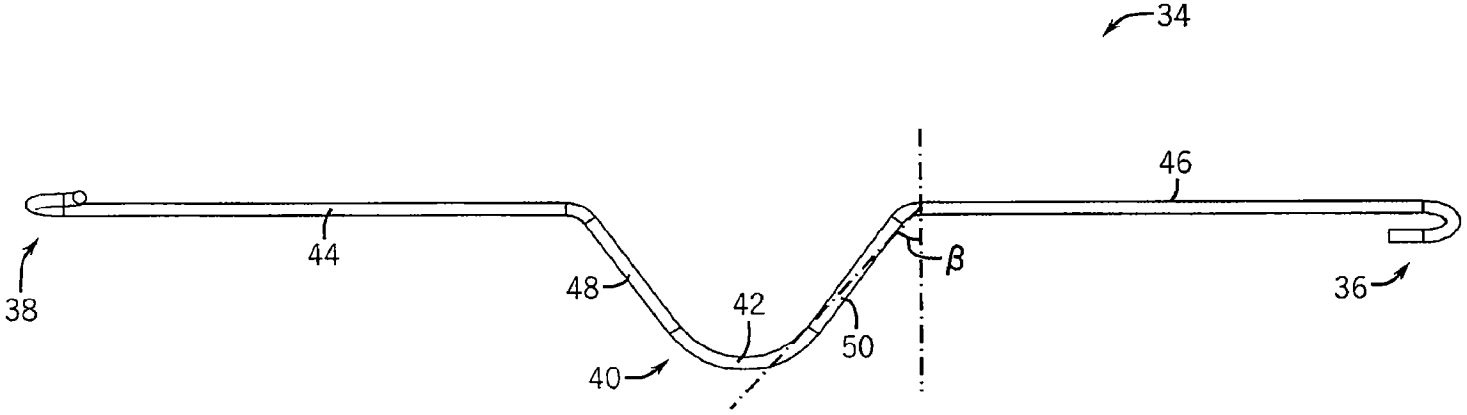
FIG. 9 is a front elevation view of the wire clip of FIGS. 7 and 8.

With additional reference to FIG. 9, the cup engaging portion 42, which may be curved, is centered along the length of the wire clip 34 between the end portions 36 and 38. The cup engaging portion 42 extends along a plane that is approximately ¾ inches below the plane of the connecting portions 44 and 46. In addition to the cup engaging portion 42, the bent portion 40 has inwardly angled arms 48 and 50 that interconnect respective ends of the cup engaging portion 42 with the connecting portions 44 and 46, respectively. While the invention is not so limited, in one embodiment, the angle, β, between connecting portion 46 and inwardly angled arm 50 is approximately 125 degrees. The angle between connecting portion 44 and arm 48 is also approximately 125 degrees.

As noted above, the end portions 36 and 38 have a partial helix shape. As shown in FIG. 9, in one embodiment, end portion 36 is turned downward whereas end portion 38 is turned upward. It is believed that having the end portions turned in opposite directions provides better mounting of the wire clip 34 to the front posts of the frame.

It is contemplated that various means may be used to mount the wire clips 34 to the frame 12. In one embodiment, which is shown in FIGS. 1-4, coils 52 are mounted to the frame 12 during the manufacturing. More particularly, coils 52 are wrapped around the front upright posts 14. The coils 52 have turns 54 that collectively define a range of positions at which the wire clip 34 may be positioned relative to the upright posts 14. While the coils 52 nominally function to hold the wire clip 34 in position, their primary function is to define the height at which the wire clip 34 may be placed. Additionally, in a preferred embodiment, the coils 52 are free to slide somewhat along the posts 14 which allows some additional variability in setting the relative height of the wire clip 34. Also, each coil has a range of turns that accommodates the conventional range of beverage cups, which is generally considered to be 3 inches to 4½ inches in diameter. In practice, each end of clip 34 is placed between a turn 54 of coil 52, preferably at a substantially similar height. The height of the clip 34 can then be adjusted, by rotating either or both coils such that the ends of the clips are raised and lowered corresponding to the amount of rotation imparted to a given coil 52.

Figure 6:
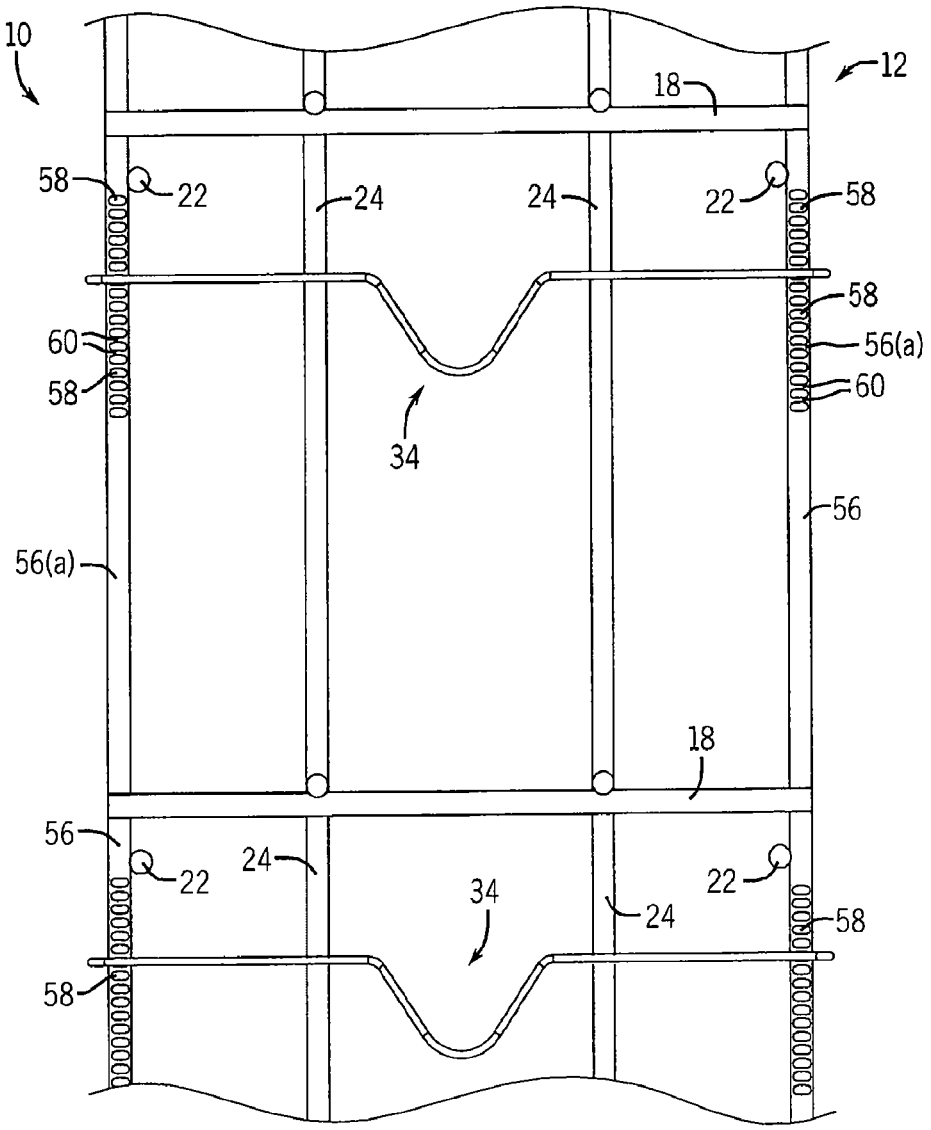
FIG. 6 is an enlarged front elevation view of a portion of the beverage cup dispenser of FIG. 5.

In another embodiment, which is representatively shown in FIGS. 5 and 6, the frame 12 has notched upright posts 56. In this regard, a vertical series of notches 58 are formed in the face 56(*a*) of each upright post 56. The notches 58 can be formed in any known or to be developed manner. Each notch 58 is formed by an adjacent pair of raised ribs 60 such that the space formed by the notch 58 defines a recess in which the ends of the wire clip 34 may sit. In a preferred embodiment, each upright post 56 has approximately sixteen notches for a given dispensing chamber. Also, preferably, adjacent ribs 60 are spaced apart by ⅛ inches. The notches shown in FIGS. 5 and 6 represent another type of device that can be used to predefine mounting positions at which the wire clip may be mounted to the upright posts. In another embodiment (not shown), the ribs are in the form of hooks and the wire clip can be positioned behind the hook. In this embodiment, the hook is shaped to prevent the wire clip from slipping upward and thus being unintentionally detached from the frame.

As described above, in one embodiment, the wire clip 34 has ends that are formed in a partial helix, which allows the ends to be wrapped around the upright posts, as shown in the figures. In another embodiment (not shown), the ends of the wire clip terminate at inline tips (butt ends) (not shown). Holes (not shown) are formed in the inward sides of the upright posts that are sized to receive the inline tips. Similar to the notches described above, in this embodiment, each post has a set of vertically arranged holes that pre-define mounting positions for the wire clip.

The illustrated beverage cup dispenser 10 has an integrated frame 12 defining a plurality of vertically stacked dispensing chambers. It is contemplated however that the frame could be of modular construction. In this embodiment, the frame would be configured to engage additional frames to form a vertical tower having a desired number of dispensing chambers. For example, each frame could define a single dispensing chamber and two additional frames could be coupled to the frame to provide a three-high vertical tower. The invention is not limited to a particular type of means for coupling multiple frames together. Also, it is contemplated that frames could be stacked laterally in addition to, or instead of, vertically.

Figure 10:
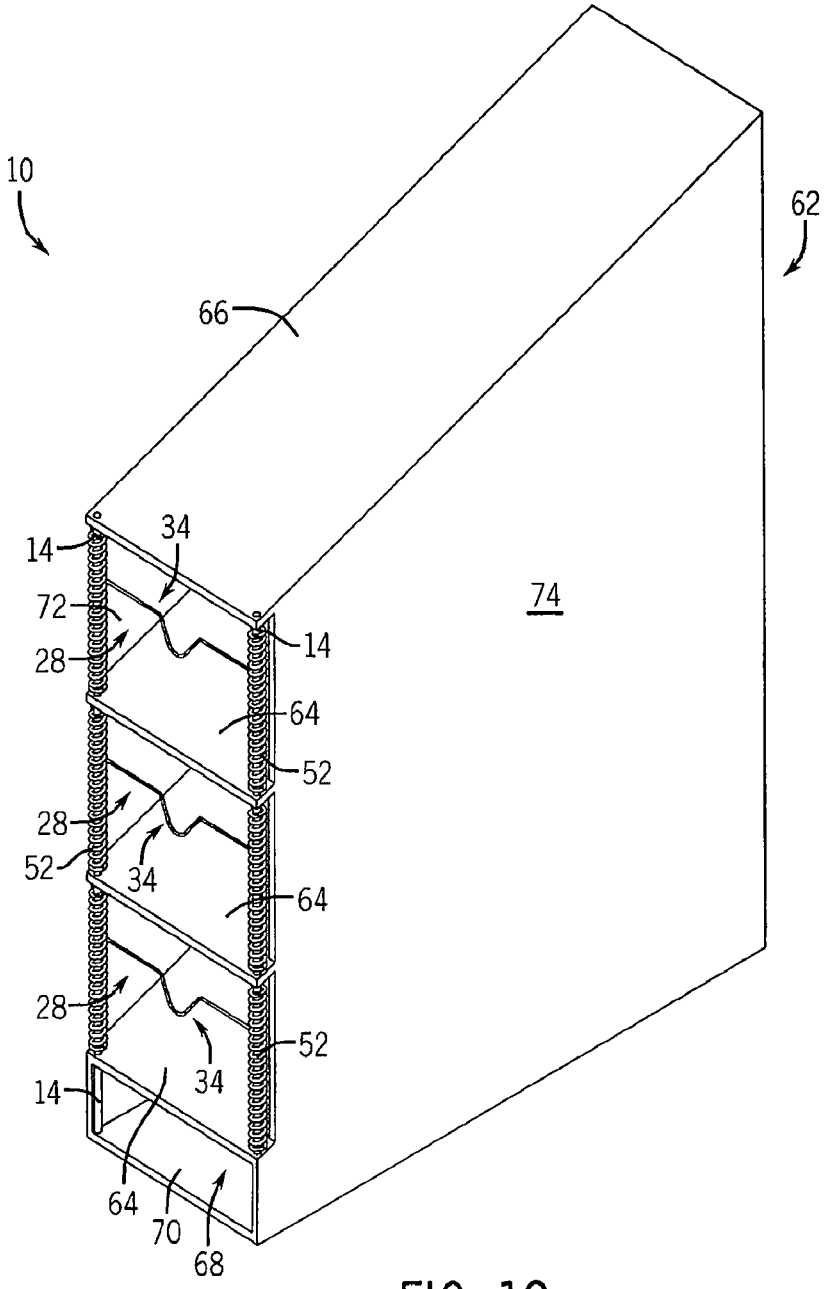
FIG. 10 is an isometric view of a container dispenser having a box frame according to another embodiment of the present invention.

Additionally, as shown in FIG. 10, the invention may be embodied in a cup dispenser 10 having a box frame 62. The box frame 62 is similar to the wire frame 12 shown in FIGS. 1-9 in that the box frame 62 defines a series of vertically oriented dispensing chambers 28. However, unlike the aforedescribed wire frame 12, the box frame 62 has spaced part shelves to form the individual dispensing chambers 28. As shown in FIG. 10, the uppermost dispensing chamber 28 is defined by a shelf 64 and a top panel 66. Situated below the lowermost dispensing chamber 28 is a compartment 68, such as for holding straws, lids, etc. The compartment 68 is defined by the shelf 64 forming the bottom of the lowermost dispensing chamber 28 and a base panel 70. The box frame 62 further includes side panels 72 and 74.

Extending between the top panel 66 and the base panel 70 are a pair of spaced apart upright posts, which in the illustrated embodiment are similar to posts 14 shown in FIGS. 1-4. It will be appreciated however that upright posts similar to posts 56 shown in FIGS. 5 and 6 could also be used. Similar to that described above, wire clips 34 engage the upright posts 14 and coils 52 are used to define a range of heights at which each clip 34 may be attached to the upright posts 14.

It will be appreciated that the shelves 64 may be inclined so that the nested stack of cups 26 are gravitationally biased toward the discharge end of each dispensing chamber. Alternately, the shelves may be oriented horizontally and biasing mechanisms, such as pushers and springs (not shown) could be used to bias the nested stack toward the discharge end.

From the foregoing description it will be appreciated that the present invention provides a low cost beverage cup dispenser that can be easily assembled to accommodate beverage cups of several diameters. To assemble the beverage cup dispenser, wire clips are attached to the upright posts for each dispensing chamber. The clips are made of spring steel and have sufficient flexibility to allow a user to bend the clips slightly so as to hook the wire clip ends around the upright posts. Simple trial and error may then be used to find the most appropriate height for a given beverage cup diameter. Alternately, the upright posts may include markings to guide user placement of the wire clips based on a given beverage cup dispenser. It will be appreciated that the cup engaging portion of the clip may be used for gripping the wire clip when attaching it to the upright posts. A typical mounting of the wire clip would thus involve latching one end of the wire clip onto one of the upright posts, and while maintaining that latching, position the wire clip across the discharge end of the dispensing chamber, and flex the wire clip slightly so as to latch the other end of the wire clip onto the opposite upright post. As mentioned above, the cup engaging portion may be gripped to assist the user in flexing the wire clip. The beverage clip is now ready for use to limit removal of beverage cups from a nested stack to one at a time.

It will be appreciated that from time to time the nature of the nested stack may result in more than one beverage cup being dispensed when the outermost beverage cup is extracted. It will also be appreciated that the size of the clip, the angle at which the cup engaging portion lies relative to the ends of the wire clip may vary depending on the type of beverage cup to be dispensed. In this regard, it is recognized that the wire clip for a plastic beverage cup, while being functionally similar, may be shaped different from that used for dispensing foam beverage cups. For example, the exact shape and/or position of the cup engaging portion described above may be varied to accommodate different cup types and sizes. Additionally, it is contemplated that the strength of the wire clips may vary depending on the type of cup being dispensed. The wire clip may be used with lipped as well as lipless beverage cups.

The present invention has been described in terms of the preferred embodiment, and it is recognized that equivalents, alternatives, and modifications, aside from those expressly stated, are possible and within the scope of the appending claims.

The invention claimed is:

1. A container dispenser comprising:

a structure adapted for holding an inverted nested stack of containers, the structure including a frame having a crossbar, first and second upright posts at opposed lateral ends of the crossbar, and a ramped structure for supporting the nested stack of containers;

a wire clip formed of uncoiled spring steel interconnected between spaced apart portions of the structure and spanning across a discharge end of the structure so as to engage an outermost container of the nested stack; and first and second coils carried by the first and second upright posts, respectively, and wherein turns of the first and second coils springs define a range of heights at which the wire clip may be attached to the first and second upright posts.

2. The container dispenser of claim 1 further comprising respective sets of notches formed in the first and the second upright posts, and wherein the sets of notches define a range of heights at which the wire clip may be attached to the first and second upright posts.

3. The container dispenser of claim 1 wherein the wire clip includes an elongated rod having first and second end portions for engaging the structure and a bent portion formed between the first and second end portions for engaging an outer surface of the outermost container of the nested stack.

4. The container dispenser of claim 3 wherein the bent portion includes a container engagement portion extending along an axis that is below that of the first and second end portions and forward of upright posts of the structure to which the wire clip is mounted.

5. The container dispenser of claim 1 wherein the structure includes a box frame defining at least one shelf adapted to support the nested stack of containers.

6. A container dispenser station comprising:

a plurality of dispensing chambers, each of the dispensing chambers defined by a pair of upright posts and a pair of crossbars spaced apart from one another; and a plurality of uncoiled wire clips removably attached to the upright posts, wherein a wire clip is associated with each of the dispensing chambers and attaches to the pair of upright posts and between the pair of crossbars for the dispensing chamber, and wherein the wire clip has a container engaging portion that engages an outer surface of an outermost container of a nested stack of containers when such a stack is loaded into the dispensing chamber.

7. The container dispenser of claim 6 further comprising a frame assembly forming the plurality of dispensing chambers, and wherein the frame assembly further includes a plurality of inclined rails, and wherein each dispensing chamber includes at least one of the inclined rails, and wherein the rail(s) for a given dispensing chamber provides a surface against which a nested stack of containers may sit when such a stack is loaded in the dispensing chamber.

8. The container dispenser of claim 7 wherein each dispensing chamber includes a pair of inclined rails.

9. The container of claim 6 further comprising height selection features attached to the upright posts for each dispensing chamber, wherein the height selection features define a range of positions at which the wire clips can be attached to the upright posts.

10. The container dispenser of claim 9 wherein the height adjustment selection features include vertically oriented coils attached to the upright posts and wherein turns of the coils represent heights at which the wire clips may be attached to the upright posts.

11. The container dispenser of claim 9 wherein the height adjustment selection features include notches formed in the upright posts and wherein the spaces between adjacent notches correspond to positions at which the wire clips may be attached to the upright posts.

12. The container dispenser of claim 6 wherein the wire clips are formed of uncoiled spring steel.

13. The container dispenser of claim 6 wherein each wire clip has first and second ends spaced from another by an elongated body having the container engaging portion, and wherein the first and second ends are each curved to partially wrap around a respective one of the upright posts.

14. The container dispenser of claim 13 wherein the container engaging portion extends along an axis that is below that of the first and second ends.

15. A container dispenser comprising:

a structure adapted for holding an inverted nested stack of containers, the structure including a frame having a crossbar, first and second upright posts at opposed lateral ends of the crossbar, and a ramped structure for supporting the nested stack of containers; and a wire clip formed of uncoiled spring steel interconnected between spaced apart portions of the structure and spanning across a discharge end of the structure so as to engage an outermost container of the nested stack; and respective sets of notches formed in the first and the second upright posts, and wherein the sets of notches define a range of heights at which the wire clip may be attached to the first and second upright posts.

16. A container dispenser comprising:

a structure adapted for holding an inverted nested stack of containers;

a wire clip formed of uncoiled spring steel interconnected between spaced apart portions of the structure and spanning across a discharge end of the structure so as to engage an outermost container of the nested stack; and wherein the wire clip includes an elongated rod having first and second end portions for engaging the structure and a bent portion formed between the first and second end portions for engaging an outer surface of an outermost container of the nested stack.

17. The container dispenser of claim 16 wherein the bent portion includes a container engagement portion extending along an axis that is below that of the first and second end portions and forward of upright posts of the structure to which the wire clip is mounted.

* * * * *